US008950839B2

(12) United States Patent
Nozawa

(10) Patent No.: US 8,950,839 B2
(45) Date of Patent: Feb. 10, 2015

(54) LIQUID CONTAINER AND LIQUID EJECTING SYSTEM

(75) Inventor: Izumi Nozawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 211 days.

(21) Appl. No.: 13/071,438

(22) Filed: Mar. 24, 2011

(65) Prior Publication Data

US 2011/0234658 A1 Sep. 29, 2011

(30) Foreign Application Priority Data

Mar. 25, 2010 (JP) ..... 2010-069857

(51) Int. Cl.
*B41J 2/195* (2006.01)
*B41J 2/175* (2006.01)

(52) U.S. Cl.
CPC ..... *B41J 2/1752* (2013.01); *B41J 2/17513* (2013.01); *B41J 2/17553* (2013.01)
USPC ..... 347/7

(58) Field of Classification Search
None
See application file for complete search history.

(56) References Cited

U.S. PATENT DOCUMENTS

| | | | | |
|---|---|---|---|---|
| 6,409,302 | B2 * | 6/2002 | Altfather et al. | 347/19 |
| 6,460,962 | B1 * | 10/2002 | Dietl et al. | 347/19 |
| 2004/0041855 | A1 | 3/2004 | Fujikawa et al. | |
| 2004/0135857 | A1 | 7/2004 | Hashii et al. | |
| 2005/0134663 | A1 | 6/2005 | Sasaki et al. | |
| 2005/0146577 | A1 | 7/2005 | Sasaki et al. | |
| 2005/0146578 | A1 | 7/2005 | Takagi et al. | |
| 2005/0146579 | A1 | 7/2005 | Sasaki et al. | |
| 2005/0146580 | A1 | 7/2005 | Hashii et al. | |
| 2005/0151812 | A1 | 7/2005 | Sasaki et al. | |
| 2005/0195225 | A1 * | 9/2005 | Takagi et al. | 347/7 |
| 2005/0200670 | A1 | 9/2005 | Hashii et al. | |
| 2006/0001717 | A1 | 1/2006 | Sasaki et al. | |
| 2006/0139384 | A1 * | 6/2006 | Kitabatake et al. | 347/7 |
| 2006/0152564 | A1 | 7/2006 | Hashii et al. | |
| 2006/0187283 | A1 | 8/2006 | Fujikawa et al. | |
| 2007/0103515 | A1 | 5/2007 | Hashii et al. | |
| 2007/0103522 | A1 | 5/2007 | Hashii et al. | |
| 2007/0273736 | A1 | 11/2007 | Sasaki et al. | |
| 2008/0007603 | A1 | 1/2008 | Fujikawa et al. | |
| 2009/0066768 | A1 | 3/2009 | Hashii et al. | |

FOREIGN PATENT DOCUMENTS

| | | | |
|---|---|---|---|
| JP | 2005-022345 | A | 1/2005 |
| JP | 2005-246781 | A | 9/2005 |
| JP | 2008-183909 | A | 8/2008 |
| JP | 2010023458 | A * | 2/2010 |

* cited by examiner

*Primary Examiner* — Geoffrey Mruk
*Assistant Examiner* — Bradley Thies
(74) *Attorney, Agent, or Firm* — Kilpatrick Townsend & Stockton LLP

(57) ABSTRACT

A liquid container mounted on a liquid ejecting apparatus to supply a liquid to the liquid ejecting apparatus. The liquid container includes a storage unit which stores the liquid, an optical member having one portion which is exposed to an inside of the storage unit, and the other portion which is exposed to an outside of the liquid container, and a reflection portion which is provided at the same side as the other portion of the optical member on the outside of the liquid container, and is installed in front of a mounting direction of the liquid container to the liquid ejecting apparatus with the other portion of the optical member.

6 Claims, 6 Drawing Sheets

LIQUID CONTAINER AND LIQUID EJECTING SYSTEM

This application claims priority to Japanese Patent Application No. 2010-069857, filed Mar. 25, 2010, the entirety of which is incorporated by reference herein.

BACKGROUND

1. Technical Field

The present invention relates to a liquid container for storing a liquid to be supplied to a liquid ejecting apparatus.

2. Related Art

In the related art, there is a liquid container for storing a liquid to be supplied to a liquid ejecting apparatus that uses a prism provided in a liquid container, as a means for detecting a residual amount of the liquid stored in the liquid container which falls below a predetermined amount. A portion of the prism protrudes into a liquid storage unit of the liquid container, and the other portion is exposed to an outer surface of the liquid container (for example, JP-A-2008-183909). In such a technology, light is incident onto the portion of the prism which is exposed from the outer surface of the liquid container, from an optical sensor provided at a printer side. When the portion of the prism which protrudes into the liquid storage unit is immersed in ink, the incident light is absorbed by the ink which comes into contact with the prism. Meanwhile, when the ink stored in the liquid storage unit is reduced and the portion of the prism protruding into the liquid storage unit is surrounded by air, the incident light is reflected by an end face of the prism, and thus is emitted in a direction of the optical sensor. Accordingly, the fact that the residual amount of the liquid stored in the liquid container falls below the predetermined amount, is detected based on the light quantity of the reflected light.

In addition, in the technology disclosed in JP-A-2008-183909, a carriage of the printer is also provided with a prism. The carriage and an ink cartridge are configured in such a way that the prism is covered by the ink cartridge when the ink cartridge is mounted on the carriage. When the ink cartridge is not mounted on the carriage, the light emitted from the optical sensor toward the prism is reflected from the end face of the prism, and thus is emitted in the direction of the optical sensor. When the ink cartridge is mounted on the carriage, the light emitted from the optical sensor toward the prism is absorbed by a wall surface of the ink cartridge.

As a result, in the technology disclosed in JP-A-2008-183909, as the carriage is moved to change the positions of the ink cartridge and the prism with respect to the optical sensor, it is possible to detect the residual amount of the ink and to determine whether or not the cartridge is mounted on the carriage, by using the same optical sensor.

However, in the above-described related art, it is necessary to provide the ink cartridge with a structure for covering the prism at the carriage side. This causes a ratio of the amount of ink, which can be stored in the ink cartridge, to the size of the ink cartridge to lessen. In addition, there are two positions, in which the carriage should be stopped with respect to the optical sensor, for detecting the mounting of the cartridge and the residual amount of the ink for one ink cartridge. Accordingly, it is necessary to accurately stop the carriage at 12 stop positions, for example, for a six-color printer. As a result, such a control is complicated. Such a problem is not limited to the printer, and is common in liquid ejecting apparatuses which supply the liquid from a detachable liquid container to eject the liquid.

SUMMARY

An advantage of some aspects of the invention is to detect mounting of a liquid container and a residual amount of a liquid with a simple configuration in the liquid container for storing the liquid to be supplied to a liquid ejecting apparatus.

In order to solve at least a part of the above problems, the invention can be achieved by aspects or applications described below.

Application 1

A liquid container mounted on a liquid ejecting apparatus to supply a liquid to the liquid ejecting apparatus includes a storage unit which stores the liquid; an optical member having one portion which is exposed to an inside of the storage unit, and the other portion which is exposed to an outside of the liquid container; and a reflection portion which is provided at the same side as the other portion of the optical member on the outside of the liquid container, and is installed in front of a mounting direction of the liquid container to the liquid ejecting apparatus with respect to the other portion of the optical member.

With the above aspect, when the liquid container is mounted on the liquid ejecting apparatus and the liquid ejecting apparatus ejects the liquid, an optical sensor provided in the liquid ejecting apparatus emits light toward the optical member. In a case where the liquid does not exist in the storage unit, the light emitted from the optical sensor toward the optical member is reflected by the portion of the optical member which is exposed to the inside of the storage unit. Furthermore, in a case where the liquid exists sufficiently in the storage unit, the light emitted from the optical sensor is not reflected by the portion of the optical member which is exposed to the inside of the storage unit, or only a smaller amount of light is reflected. This can detect whether or not the liquid of a predetermined amount or more exists in the storage unit, based on the quantity of the reflected light or the presence or absence of the reflected light.

In addition, when a new liquid container is mounted on the liquid ejecting apparatus, it is possible to detect whether or not the liquid container is completely mounted on the liquid ejecting apparatus by the same optical sensor which is provided in the liquid ejecting apparatus. That is, when the new liquid container is completely mounted on the liquid ejecting apparatus, the light emitted from the optical sensor to the optical member is not reflected, or only a smaller amount of light is reflected. If the new liquid container is not completely mounted on the liquid ejecting apparatus, the light is reflected from the optical sensor by the reflection portion which is installed at the position more to the front than the optical member in the mounting direction of the liquid container to the liquid ejecting apparatus. This can detect whether or not the liquid container is completely mounted on the liquid ejecting apparatus, based on the quantity of the reflected light or the presence or absence of the reflected light.

Accordingly, the liquid container for storing the liquid to be supplied to the liquid ejecting apparatus can detect the mounting of the liquid container and the residual amount of the liquid with the simple configuration.

It is desirable that the optical member is made of a material having a refractive index lower than the liquid stored in the storage unit and higher than air, and being transparent to light.

In addition, the expression "A is provided at the same side as B" in the liquid container means the following. That is, when the liquid container is divided into two parts on the basis of a plane passing through a center of gravity of the liquid container, if the plane is set so that A and B are positioned at the same side with respect to the plane, it is said that "A is provided at the same side as B".

Application 2

The liquid container according to Application 1 further includes a fitting portion provided at a side opposite to the optical member and the reflection portion, in which when the liquid container is mounted on the liquid ejecting apparatus, the fitting portion is mounted further to a front side than the portion of the liquid container at which the optical member and the reflection portion are installed, and the fitting portion is fitted with a configuration provided at the liquid ejecting apparatus.

With the above aspect, when the liquid container is mounted on the liquid ejecting apparatus, the liquid container is rotated around the fitting portion which is fitted with the configuration of the liquid ejecting apparatus. The portion provided with the optical member and the reflection portion is mounted on the liquid ejecting apparatus, and then the mounting of the liquid container is completed. That is, the mounting operation of the liquid container can be underspecified. This can determine whether or not the liquid container is completely mounted on the liquid ejecting apparatus, based on the position of the optical member and the reflection portion which are located along the mounting direction. Accordingly, it is possible to more reliably detect whether or not the liquid container is completely mounted on the liquid ejecting apparatus.

The expression "C is provided at the opposite side from A and B" means the following. That is, when the liquid container is divided into two parts on the basis of a plane passing through the center of gravity of the liquid container, if the plane is set so that A and B are positioned at the opposite side with respect to the plane, it is said that "C is provided at the opposite side from A and B".

Application 3

The liquid container according to Application 2 further includes a terminal which comes into contact with a terminal of the liquid ejecting apparatus when the liquid container is mounted on the liquid ejecting apparatus, to send a desired signal to the liquid ejecting apparatus, and which is installed at a position closer to the fitting portion than the optical member and the reflection portion.

With the above aspect, the terminal of the liquid container comes into contact with the terminal of the liquid ejecting apparatus, before the optical member reaches the mounting position. For this reason, a signal is sent from the terminal of the liquid container, and when the reflected light exceeds a predetermined amount, the liquid ejecting apparatus can determine that "the liquid container is incompletely mounted". When no signal is sent from the terminal of the liquid container, the liquid ejecting apparatus can determine that "the liquid container is not mounted".

Application 4

A liquid ejecting system includes a liquid ejecting apparatus which ejects a liquid, and a liquid container which is mounted on the liquid ejecting apparatus to supply the liquid to the liquid ejecting apparatus, the liquid container including a storage unit which stores the liquid; an optical member having one portion which is exposed to an inside of the storage unit, and the other portion which is exposed to an outside of the liquid container; and a reflection portion which is provided at the same side as the other portion of the optical member on the outside of the liquid container, and is installed in front of a mounting direction of the liquid container to the liquid ejecting apparatus with respect to the other portion of the optical member, the liquid ejecting apparatus including an optical sensor which emits light toward a position which should be occupied by the optical member of the liquid container mounted on the liquid ejecting apparatus, and receives reflected light emitted from the position; a display unit which performs a desired display for a user; and a control unit which performs a first display indicating a small residual amount of the liquid on the display unit in a case where a first condition including a fact that the optical sensor receives the reflected light of a predetermined amount or more is satisfied when the liquid is ejected, and which performs a second display different from the first display on the display unit in a case where a second condition including a fact that the optical sensor does not receive the reflected light of a predetermined amount or more is satisfied when the liquid is ejected, or does not perform the display on the display unit, wherein the control unit performs a third display indicating that mounting of the liquid container is insufficient in a case where a third condition including a fact that the optical sensor receives the reflected light of the predetermined amount or more is satisfied when the liquid container is mounted on the liquid ejecting apparatus, and performs a fourth display different from the third display on the display unit in a case where a fourth condition including a fact that the optical sensor does not receive the reflected light of the predetermined amount or more is satisfied when the liquid container is mounted on the liquid ejecting apparatus, or does not perform the display on the display unit.

With the above aspect, when the liquid container is mounted on the liquid ejecting apparatus so that the liquid ejecting apparatus ejects the liquid, the light is emitted from the optical sensor toward the optical member. Based on the quantity or the presence or absence of the reflected light, the liquid ejecting apparatus can perform the first display indicating the small residual amount of the liquid for the user. This can prevent a case where the user lets the liquid ejecting apparatus eject the liquid in the state in which the liquid runs out.

In addition, when a new liquid container is mounted on the liquid ejecting apparatus, the light is emitted from the optical sensor toward the position which should be occupied by the optical member. Based on the quantity or the presence or absence of the reflected light, the liquid ejecting apparatus can perform the third display indicating the insufficient mounting of the liquid container for the user. This can prevent a case where the user lets the liquid ejecting apparatus eject the liquid in the state in which the mounting of the liquid container is insufficient.

In this instance, a portion, which emits the light, of the optical sensor, and a portion, which receives the reflected light, of the optical sensor may be installed in one housing, and the portions may be configured as a separate member.

In addition, in a case where "any condition X includes the following condition A", a condition X may include a condition B other than the condition A.

Application 5

The liquid ejecting system according to Application 4 further includes a first fitting portion provided at a side opposite to the optical member and the reflection portion, in which when the liquid container is mounted on the liquid ejecting apparatus, the fitting portion is mounted further to a front side than the portion of the liquid container at which the optical member and the reflection portion are installed, and the first fitting portion is fitted with a second fitting portion provided at the liquid ejecting apparatus, and the liquid ejecting apparatus further includes the second fitting portion fitting with the first fitting portion.

Application 6

The liquid ejecting system according to Application 5 further includes a first terminal connected to the control unit; the liquid container further includes a second terminal which comes into contact with the first terminal of the liquid ejecting apparatus when the liquid container is mounted on the liquid ejecting apparatus, to send a desired signal to the control unit, and which is installed at a position closer to the fitting portion than the optical member and the reflection portion; the third and fourth conditions further include the control unit that receives the desired signal from the liquid container; and the fourth display includes a display indicating that the liquid container is accurately mounted on the liquid ejecting apparatus.

With the above aspect, the terminal of the liquid container comes into contact with the terminal of the liquid ejecting apparatus, before the optical member reaches the mounting position. For this reason, when a signal is sent from the terminal of the liquid container, the liquid ejecting apparatus can determine that "the liquid container is completely or incompletely mounted". Accordingly, based on the quantity or the presence or absence of the reflected light, the third display indicating the insufficient mounting of the liquid container, and the fourth display including the display indicating that the liquid container is accurately mounted on the liquid ejecting apparatus can be appropriately displayed for the user if necessary.

Application 7

The liquid ejecting system according to Application 5 or 6 further includes a third fitting portion which is provided at the same side as the optical member and the reflection portion, and is fitted with a fourth fitting portion provided at the liquid ejecting apparatus when the liquid container is mounted on the liquid ejecting apparatus; the liquid ejecting apparatus further includes the fourth fitting portion fitted with the third fitting portion; at least one of the liquid ejecting apparatus and the liquid container further includes a resilient member resiliently supporting the liquid container in a state in which the first fitting portion is fitted with the second fitting portion, the third fitting portion is not fitted with the fourth fitting portion, and the reflection portion reflects the light emitted from the optical sensor to the optical sensor; and in a state in which the liquid container is pushed into the liquid ejecting apparatus against a resilient force of the resilient member, the third fitting portion is fitted with the fourth fitting member, so that the liquid container is mounted on the liquid ejecting apparatus.

With the above aspect, the liquid container which is incompletely mounted on the liquid ejecting apparatus can be further reliably located by an action of the resilient member in a state in which the reflection portion reflects the light emitted from the optical sensor to the optical sensor. As a result, the liquid ejecting apparatus can perform the third display with higher accuracy based on the quantity or the presence or absence of the reflected amount.

In this instance, since the third fitting portion is fitted with the fourth fitting portion, it is desirable that the liquid container is fixed in a state in which the liquid container is mounted on the liquid ejecting apparatus, against the resilient force of the resilient member.

Furthermore, it is desirable that at least one of the third and fourth fitting portions is installed in a resiliently deformable manner.

Application 8

In the liquid ejecting system according to Application 7 defining Application 6, the first terminal comes into contact with the second terminal in the desired state.

With the above configuration, it is possible to detect that the liquid container is incompletely mounted on the liquid ejecting apparatus in the above desired state, with higher accuracy, based on the signal and the reflected light from the terminal of the liquid container.

In this instance, the invention can be achieved by various aspects as described below.

(1) Liquid container, liquid supply apparatus, and liquid supplying method (2) Liquid storing unit and ink supply apparatus (3) Liquid consuming apparatus and ink jet printer

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Embodiment 1

Figure 1:
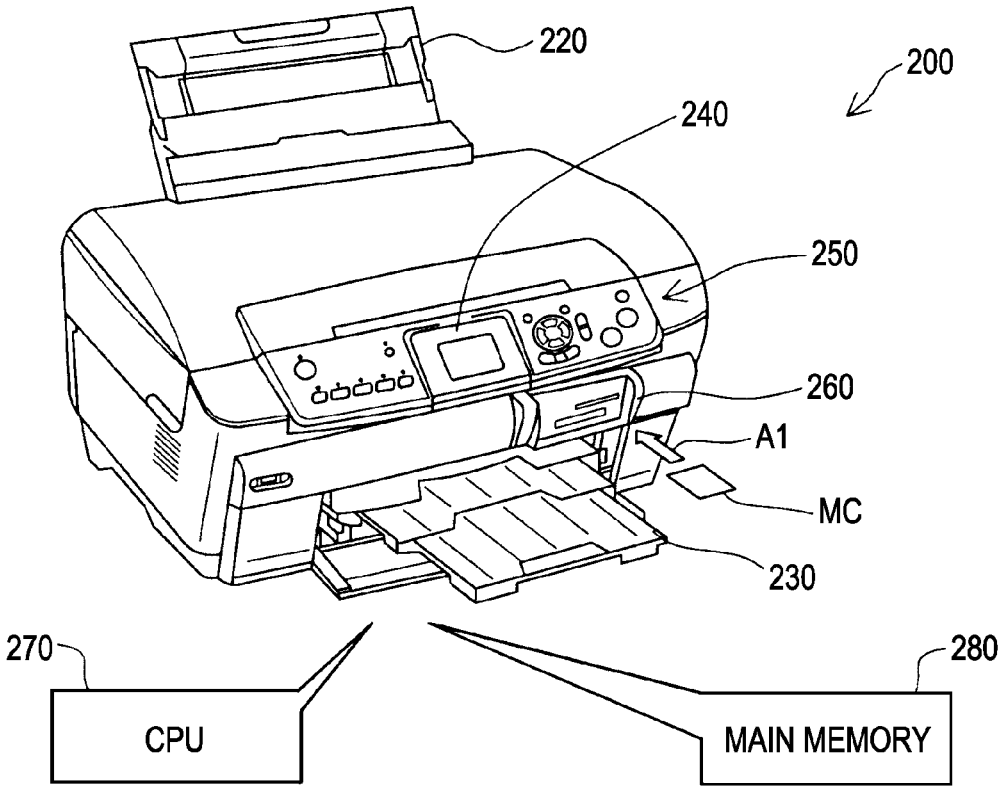
FIG. 1 is a perspective view illustrating a printer according to an embodiment of the invention.

FIG. 1 is a perspective view illustrating a printer 200 according to an embodiment of the invention. The printer 200 is a printer which is not connected to an external computer and can independently perform printing based on an image data file stored in a memory medium. The printer 200 includes a printing head (not illustrated) for ejecting ink droplets to perform the printing, an automatic sheet feeder 220 for supplying printing sheets, a sheet discharge tray 230 for receiving the printing sheet printed with the image, a liquid crystal display 240, a group of buttons 250 for performing various manipulation, a card slot 260 for receiving a memory card and reading data, a CPU 270, and a main memory 280.

In the card slot 260, a memory card MC, such as a compact flash (registered trademark) card, an SD card, a mini SD card, a memory stick, a smart media card, or the like can be directly inserted into a slot, or can be inserted through an adaptor (refer to an arrow A1 in FIG. 1). The CPU 270 can obtain the image data file stored in the memory card MC through the card slot 260. The CPU 270 executes the printing based on the image data file.

Figure 2:
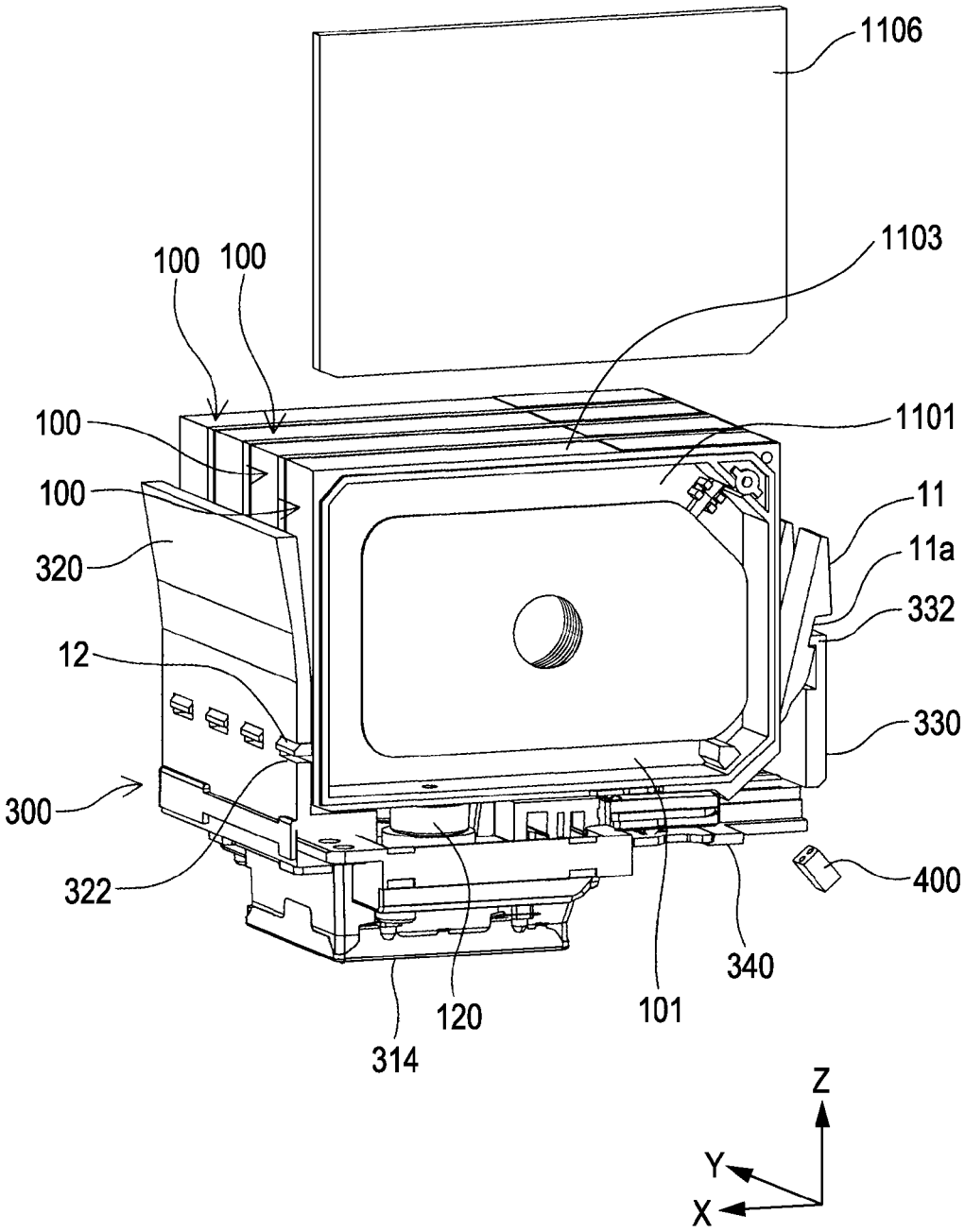
FIG. 2 is a perspective view illustrating a carriage provided in a printer, and an ink cartridge mounted on the carriage.

FIG. 2 is a perspective view illustrating the carriage 300 provided in the printer 200, and the ink cartridge 100 mounted on the carriage 300. In FIG. 2, the carriage 300 and the ink cartridge 100 are partially cut away in a cross section thereof so as to make the technology easily to understand. In addition, FIG. 2 shows a state in which one wall portion 1106 of the ink cartridge 100 is removed.

The carriage 300 includes a printing head 314 at the bottom surface thereof. A plurality of ink cartridges 100 are mounted at a side (upper side in FIG. 2) of the carriage 300 opposite to the printing head 314. Since FIG. 2 shows the state in which the carriage 300 and the ink cartridge 100 are partially cut away in a cross section thereof, only four ink cartridges 100 are illustrated. However, in fact, six ink cartridges 100 stored with the ink of different colors are mounted on the carriage 300.

The carriage 300 mounted with the ink cartridges 100 is reciprocated in a main scanning direction (Y-axis direction shown in FIG. 2) by a main scanning mechanism including an endless belt. During reciprocation, the ink of each color is supplied to the printing head 314 from each ink cartridge 100 through a supply unit 120. The ink of each color is discharged from the printing head 314 based on the image data. As a result, a dot of each color is formed on a printing medium to form an image.

The carriage 300 stores the ink cartridges 100 in a space enclosed by wall portions 320, 330, and 340. In the carriage 300, the wall portion 320, of the wall portions defining the space receiving the ink cartridges 100 therein, in a positive X-axis direction is provided with a plurality of holes 322 at a position corresponding to each ink cartridge 100 in a Y-axis direction. The hole 322 is provided near a lower end of the wall portion 320. A convex portion 12 provided at each ink cartridge 100 is inserted into the hole 322.

In this instance, the Y axis coincides with the main scanning direction. A positive Z-axis direction coincides with a vertically upper side. The X axis coincides with a forward and rearward direction of the printer 200. In printer 200, a surface of a negative X axis is a surface facing a user (refer to FIG. 1).

Figure 3:
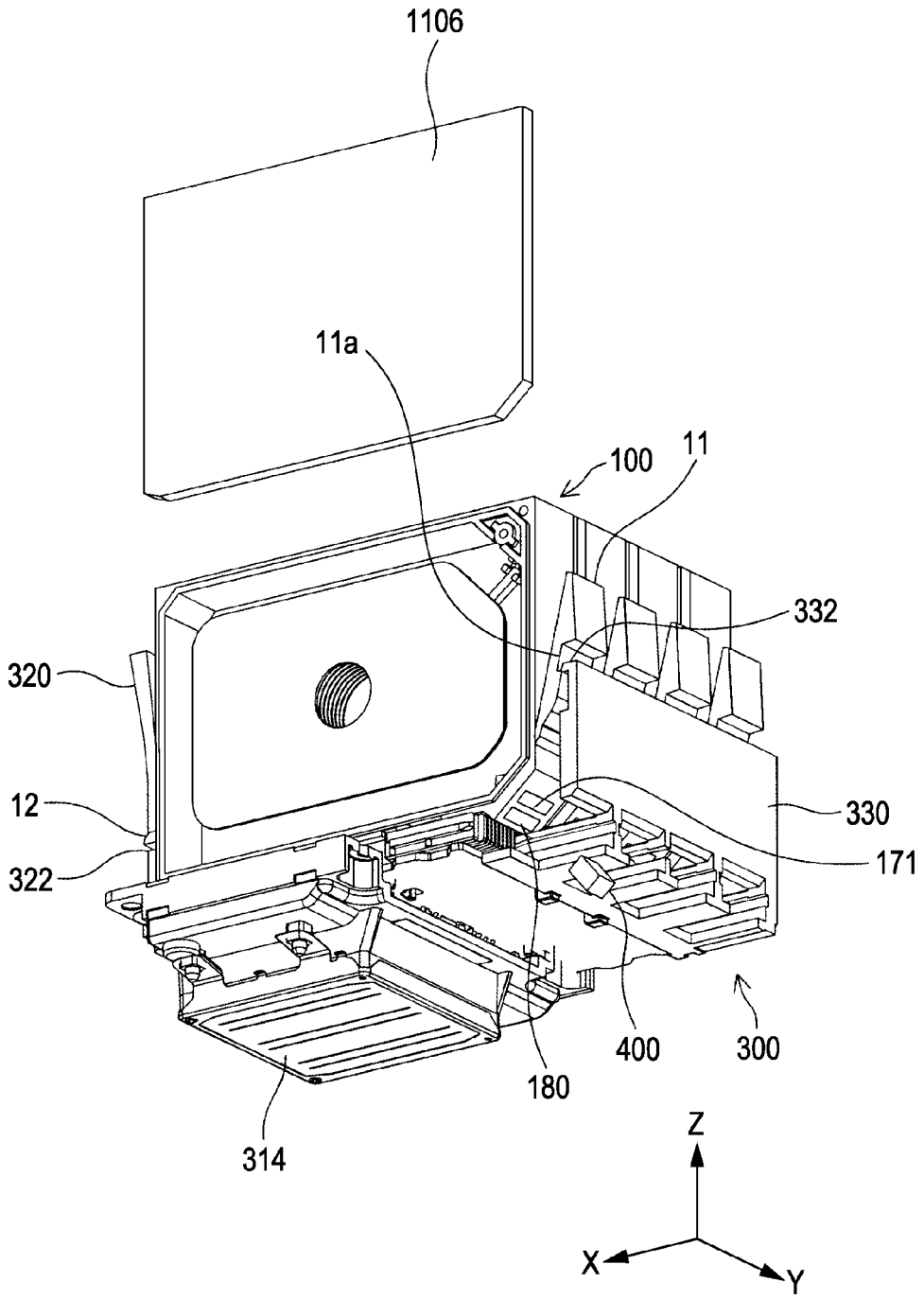
FIG. 3 is a perspective view illustrating a carriage and an ink cartridge mounted on the carriage.

FIG. 3 is a perspective view illustrating the carriage 300 and the ink cartridge 100 mounted on the carriage 300. FIG. 3 is a view of the carriage 300 which is seen from a direction different from FIG. 2. In FIG. 3, the carriage 300 and the ink cartridge 100 are partially cut away in a cross section thereof so as to make the technology easy to understand. In addition, FIG. 3 shows a state in which one wall portion 1106 of the ink cartridge 100 is removed.

As shown in FIG. 3, in the carriage 300, the wall portion 330, of the wall portions defining the space receiving the ink cartridges 100 therein, in a negative X-axis direction is provided with one claw 332 at a position opposite to each ink cartridge 100. The claw 332 is fitted with a concave portion 11*a* of an engagement lever 11 which is provided at each ink cartridge 100.

The engagement lever 11 has resilience. When the ink cartridge 100 is mounted on the carriage 300, first, a convex portion 12 of the ink cartridge 100 is inserted into the hole 322 formed in the wall portion 320 of the carriage 300 (refer to FIG. 2). After that, the side of the ink cartridge 100 which is provided with the engagement lever 11 is brought down in the negative Z-axis direction, and thus the engagement lever 11 comes into contact with the claw 332 and is resiliently deformed in the positive X-axis direction. If the ink cartridge 100 is further brought down in the negative Z-axis direction, the claw 332 is fitted with the concave portion 11*a* of the engagement lever 11. The ink cartridge 100 is fixed to the carriage 300 by the fitting of the claw 332 with the concave portion 11*a* and the fitting of the convex portion 12 with the hole 322.

The printer 200 is provided with one optical sensor 400 (refer to FIG. 2 and FIG. 3). The optical sensor 400 emits light toward a position in which the ink cartridge 100 is located, and receives the light reflected from the corresponding position. The optical sensor 400 transmits a signal corresponding to a quantity of the received light to the CPU 270.

The optical sensor 400 is installed in a fixed manner in the printer 200. That is, the optical sensor 400 does not move with the carriage 300. The optical sensor 400 is adapted to emit the light toward the position described below. The position means (i) a position in which the ink cartridge 100 is appropriately mounted on the carriage 300, and (ii) a position in which when the carriage 300 arranges the ink cartridge 100 at an appropriate position (position opposite to the optical sensor 400) in the Y-axis direction (main scanning direction), the ink cartridge 100 should be located (more specifically, a surface 171 of a prism 170 described below should be located).

Figure 4:
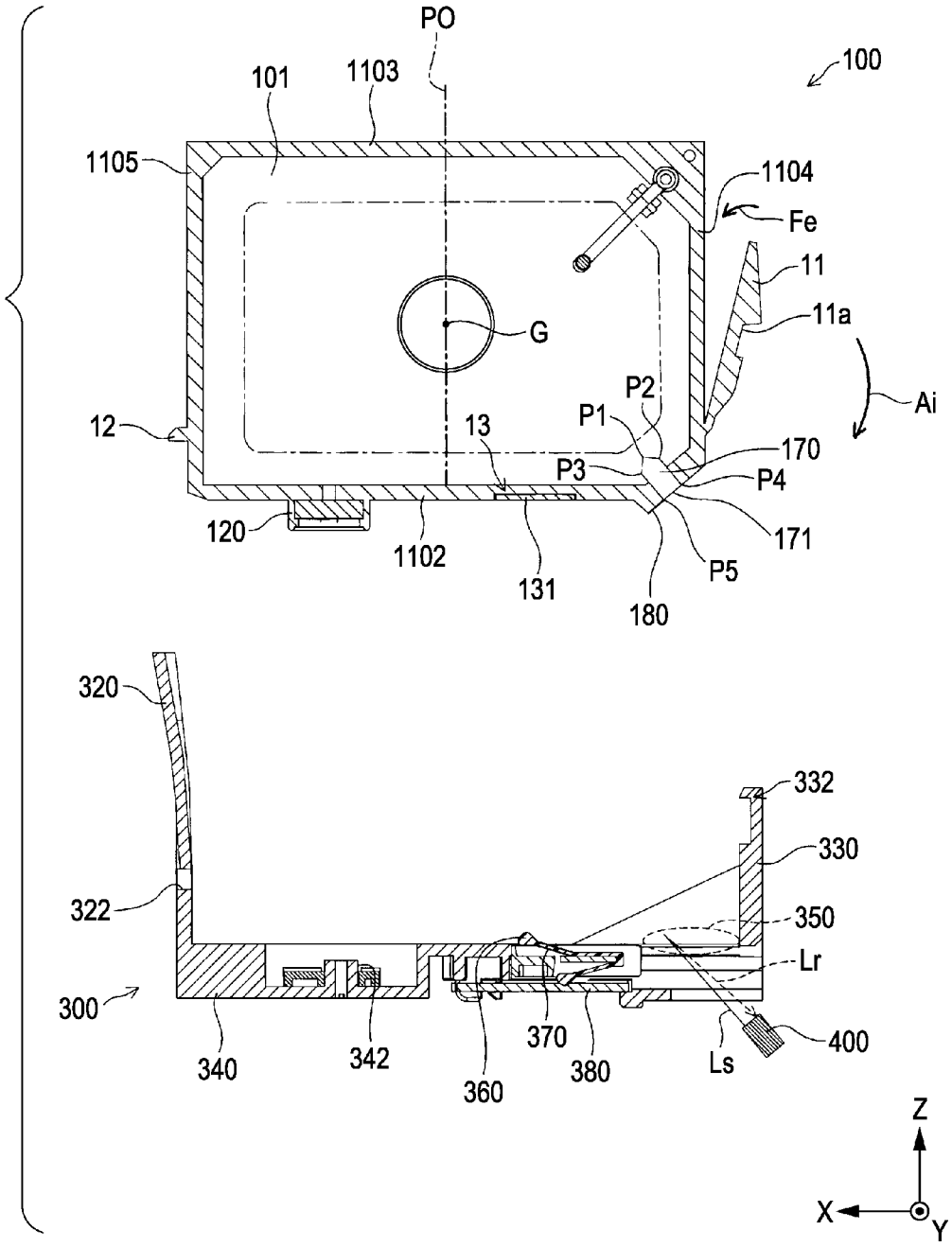
FIG. 4 is a cross-sectional view illustrating a state before an ink cartridge is mounted on a carriage.

FIG. 4 is a cross-sectional view illustrating the state before the ink cartridge 100 is mounted on the carriage 300. In FIG. 4, the printing head 314 is omitted so as to make the technology easy to understand. The ink cartridge 100 is a substantially rectangular parallelepiped ink container having an in storage unit 101 which is enclosed by six wall portions 1101 to 1106. The wall portion 1101 is a wall portion positioned at the negative Y-axis side. The wall portion 1106 is a wall portion positioned at the positive Y-axis side. The wall portion 1106 is not shown in FIG. 4. The wall portion 1102 is a wall portion positioned at the negative Z-axis side. The wall portion 1103 is a wall portion positioned at the positive Z-axis side. The wall portion 1104 is a wall portion positioned at the negative X-axis side. The wall portion 1105 is a wall portion positioned at the positive X-axis side.

In the state in which the ink cartridge 100 is accurately mounted on the carriage 300, the Y-axis coincides with the main scanning direction. Similarly, the positive Z-axis direction coincides with the vertically upper side. The X-axis coincides with the forward and rearward direction of the printer 200. When the direction of each portion of the ink cartridge 100 is described, an XYZ-axis used in the printer 200 is used, supposing that the ink cartridge 100 is accurately mounted on the carriage 300.

The ink cartridge 100 includes a convex portion 12 near the lower end of the wall portion 1105. The convex portion 12 is inserted into the hole 322 in the state in which the ink cartridge 100 is mounted on the carriage 300, as described above. Since the convex portion 12 is provided near the lower end of the wall portion 1105 which is located at a rear side (positive X-axis side) when seen from a user, when the ink cartridge 100 is mounted on the carriage 300, alignment of the convex portion 12 to the hole 322 is easy. In this instance, the expression "near the lower end of the wall portion" means a range of ¼ or less of the full length of the wall portion from the lower end.

The ink cartridge 100 includes the engagement lever 11 near the lower end of the wall portion 1104. The engagement lever 11 extends in the positive Z-axis and in the negative X-axis direction from a position near the lower end of the wall portion 1104. The engagement lever 11 has a concave portion 11*a* on the surface of the negative X-axis side. The concave portion 11*a* receives the claw 332 in the state in which the ink cartridge 100 is mounted on the carriage 300, as described above.

When the ink cartridge 100 is mounted on the carriage 300, as described above, the convex portion 12 of the ink cartridge 100 is inserted into the hole 322 formed in the wall portion 320 of the carriage 300. After that, the side of the ink cartridge 100 which is provided with the engagement lever 11 is brought down in the negative Z-axis direction. That is, the ink cartridge 100 is rotated around the hole 322 of the carriage 300 and the convex portion 12 of the ink cartridge 100. The claw 332 is fitted with the concave portion 11*a* of the engagement lever 11. In FIG. 4, the rotation direction of the ink cartridge 100 when the ink cartridge 100 is mounted on the carriage 300 is indicated by an arrow Ai.

In this embodiment, the engagement lever 11 is provided at the wall portion 1104 which is located at a front side (negative X-axis side) when seen from a user, and the concave portion

11*a* is provided on the surface of the negative X-axis side of the engagement lever 11. For this reason, when the ink cartridge 100 is mounted on the carriage 300, the engagement lever 11 is resiliently deformed in the positive X-axis side (refer to an arrow Fe) to easily fit the concave portion 11*a* with the claw 332.

The ink cartridge 100 includes the prism 170 near the border between the wall portion 1104 and the wall portion 1102. The prism 170 is a substantially pentagonal column whose axis is in the Y-axis direction. The pentagonal cross section of the prism 170 in the plane extending in the X-axis and the Y-axis has one vertex p1 with an internal angle of 90 degrees, two vertexes p2 and p3 which are positioned to interpose the vertex therebetween and have an obtuse internal angle, and two other vertexes p4 and p5 with an internal angle of 90 degrees.

The portion of the prism 170 which is formed in the shape of a substantially triangular column extending to the vertexes p1 to p3 is exposed in the ink storage unit 101. For this reason, the ink of a predetermined amount or more exists in the ink storage unit 101, a surface extending to the vertex p1 and the vertex p2, and a surface extending to the vertex p1 and the vertex p3 are tangent to the ink. A surface 171 extending to the vertex p4 and the vertex p5 is exposed to the outer surface of the ink cartridge 100.

A reflection portion 180 is provided at a portion which is an outer surface of the ink cartridge 100 near the border between the wall portion 1104 and the wall portion 1102, and is further to a front side than the exposed portion 171 of the prism 170 in the rotation direction Ai of the ink cartridge 100 when the ink cartridge 100 is mounted on the carriage 300. The reflection portion 180 can reflect the light received from the exterior.

In this embodiment, as described above, the convex portion 12 of the ink cartridge 100 is inserted into the hole 322 formed in the wall portion 320 of the carriage 300. After that, the ink cartridge 100 is rotated around the hole 322 of the carriage 300 and the convex portion 12 of the ink cartridge 100. That is, the movement of the reflection portion 180 and the exposed portion 171 when the ink cartridge 100 is mounted on the carriage 300 can be uniquely determined by the hole 322 and the convex portion 12. More specifically, the exposed portion 171 can be located at the position in which the reflection portion 180 has been located. Accordingly, as described below, by using the replacement of the reflection portion 180 and the exposed portion 171 at the desired portion, it is possible to detect the incomplete mounting of the ink cartridge 100 with high precision.

In addition, the reflection portion 180 and the prism 170 are provided near the lower end of the wall portion 1104 of the negative X-axis side. The convex portion 12 is provided near the lower end of the wall portion 1104 of the positive X-axis side. That is, the reflection portion 180 and the prism 170, and the convex portion 12 are provided at the opposite sides in the ink cartridge 100. For this reason, slight misalignment of the angle in the rotating movement (refer to the arrow Ai) when the ink cartridge 100 is mounted on the carriage 300 can crate a large misalignment between positions of the reflection portion 180 and the prism 170. Therefore, as described below, it is possible to detect the incomplete mounting of the ink cartridge 100 with high precision by using the replacement of the reflection portion 180 and the exposed portion 171 at the desired position.

In this instance, the ink cartridge 100 can distinguish the side on which the reflection portion 180, the prism 170, and the concave portion 11*a* of the engagement lever 11 exist, and the side on which the concave portion 12 exists, by the plane P0 passing through the center of gravity G thereof. These states are herein referred to as "the reflection portion 180, the prism 170, and the concave portion 11*a* of the engagement lever 11 exist on the same side", and "the reflection portion 180, the prism 170 and the concave portion 11*a* of the engagement lever 11, and the convex portion 12 exist on the opposite sides".

The ink cartridge 100 includes a circuit board 13 on the wall portion 1102. The circuit board 13 includes a memory, a terminal 131 exposed at the outside of the ink cartridge 100, and a circuit connected thereto. The terminal 131 is provided at a position closer to the convex portion 12 than the concave portion 11*a* of the engagement lever 11, the prism 170 and the reflection portion 180. The memory is stored with information about the kinds of ink stored in the ink cartridge 100, the residual amount of the ink which is recorded by the CPU 270 of the printer 200 via the terminal 131, or the like. The information is supplied to the CPU 270 of the printer 200 via the terminal 131.

The carriage 300 stores the ink cartridge 100 in the space enclosed by the wall portions 320, 330, and 340. The wall portion 320 is a wall portion which is positioned at the positive X-axis side. The wall portion 330 is a wall portion which is positioned on negative X-axis side. The wall portion 340 is a wall portion which is positioned at the negative Z-axis side.

The wall portion 320 is provided with the above-described hole 322 at the position corresponding to each ink cartridge 100. The wall portion 330 is provided with the above-described claw 332 at the position corresponding to each ink cartridge 100.

A portion of the wall portion 340 is provided with a needle 342 at the position corresponding to the supply unit 120 of each ink cartridge 100. When the ink cartridge 100 is mounted on the carriage 300, the needle 342 is inserted into the supply unit 120. An ink supply passage is formed in the needle 342 and the supply unit 120. The ink is supplied from the ink cartridge 100 to the printing head 314 through the ink supply passage.

A portion of the wall portion 340 is provided with a hole 350 at the position corresponding to the prism 170 of each ink cartridge 100 and the reflection portion 180. That is, in the state in which the ink cartridge 100 is appropriately mounted on the carriage 300, the prism 170 and the reflection portion 180 are positioned in the hole 350. When any ink cartridge 100 is located at an appropriate position of the Y-axis direction by the carriage 300, the optical sensor 400 of the printer 200 can irradiate the light onto the position, at which the surface 171 of the prism 170 of the ink cartridge 100 should be located, through the hole 350.

A portion of the wall portion 340 is provided with a terminal 360 at the position corresponding to the terminal 131 of the circuit board 13 of each ink cartridge 100. That is, in the state in which the ink cartridge 100 is properly mounted on the carriage 300, the terminal 360 comes into contact with the terminal 131 of the circuit board 13 of the ink cartridge 100. The terminal 360 is installed at the position closer to the hole 322 of the wall portion 320 than the hole 350 which is located at the position corresponding to the prism 170 and the reflection portion 180.

The terminal 360 is supported by a resilient portion 370 which protrudes in the positive Z-axis direction from the upper surface of the wall portion 340 in a state in which the terminal is not applied by an external force. The terminal 360 is supported in such a way that it is resiliently deformed in the negative Z-axis direction by the resilient portion 370. More specifically, the terminal 360 is a metallic component which is installed integrally with the resilient portion 370.

The resilient portion 370 has a conductive property, and functions as a portion of an electrical circuit. The resilient portion 370 is connected to a substrate 380 which is installed at the negative Z-axis side of the wall portion 340. The substrate 380 is connected to the CPU 270. When the ink cartridge 100 is mounted on the carriage 300, the terminal 360 is pushed down by the terminal 131 of the circuit board 13 of the ink cartridge 100, and thus is electrically connected to the terminal 131. The CPU 270 of the printer 200 acquires the information from the memory of the circuit board 13 of the ink cartridge 100 via the substrate 380, the terminal 360, and the terminal 131 of the circuit board 13 of the ink cartridge 100.

Figure 5:
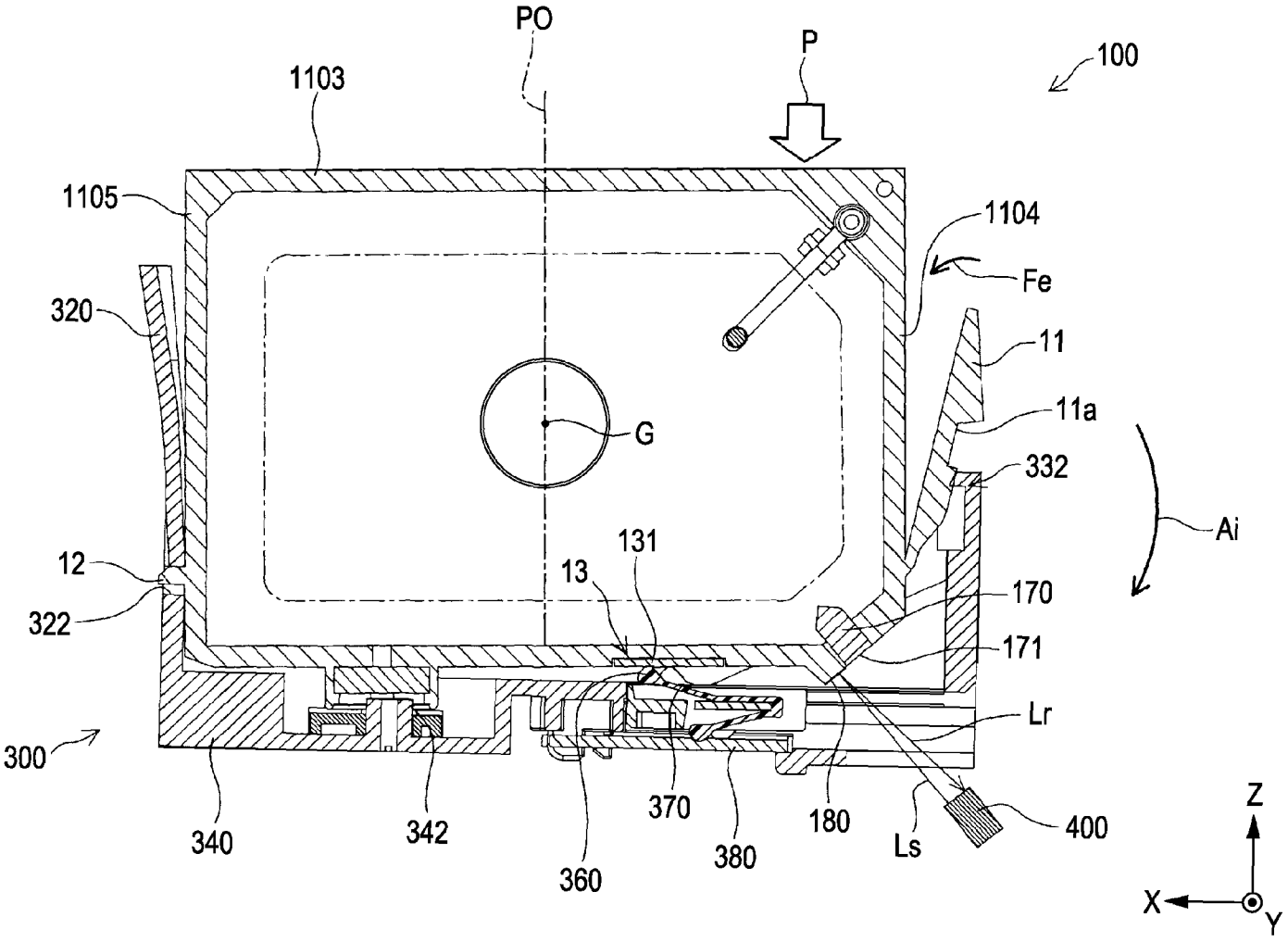
FIG. 5 is a cross-sectional view illustrating a state in which an ink cartridge is incompletely mounted on a carriage.

FIG. 5 is a cross-sectional view illustrating the state in which the ink cartridge 100 is incompletely mounted on the carriage 300. In FIG. 5, the printing head 314 is omitted so as to make the technology easy to understand. When the ink cartridge 100 is mounted on the carriage 300, as described above, the convex portion 12 of the ink cartridge 100 is first inserted into the hole 322 of the wall portion 320 of the carriage 300 (refer to FIG. 5). FIG. 5 shows the state in which the convex portion 12 is inserted into the hole 322 and the ink cartridge 100 is not applied by the external force.

In the state shown in FIG. 5, the ink cartridge 100 is supported by the resilient portion 370 and the terminal 360 at the terminal 131 of the circuit board 13. In this state, the CPU 270 of the printer 200 can acquire the information from the memory of the circuit board 13 of the ink cartridge 100 via the substrate 380, the terminal 360, and the terminal 131 of the circuit board 13 of the ink cartridge 100.

Meanwhile, in the state shown in FIG. 5, the reflection portion 180 is located at the position facing the optical sensor 400 of the printer 200. In this instance, it is regarded that the optical sensor 400 and the ink cartridge 100 are located at an appropriate relative position in the Y-axis direction. If the optical sensor 400 emits the light Ls toward the position, at which the exposed portion 171 of the prism 170 should be located, under the control of the CPU 270, the light is not reflected by the prism 170, but is reflected by the reflection portion 180. The optical sensor 400 receives the reflected light Lr.

After the state shown in FIG. 5, the prism 170 of the wall portion 1103 of the ink cartridge 100 and the portion of the reflection portion 180 side are pushed down (refer to the arrow P in FIG. 5), the ink cartridge 100 is rotated around the hole 322 of the carriage 300 and the convex portion 12 of the ink cartridge 100 (refer to the arrow Ai). As a result, the engagement lever 11 is pushed down by the claw 332 and thus is resilient deformed (refer to the arrow Fe), so that the claw 332 is fitted with the concave portion 11*a* of the engagement lever 11. In this instance, a user may push down the wall portion 1103 of the ink cartridge 100 in the direction of the arrow P, and simultaneously push down the engagement lever 11 in the direction of the arrow Fe to mount the ink cartridge 100 on the carriage 300.

In this embodiment, the terminal 360 of the carriage 300 side and the terminal 131 of the ink cartridge 100 side are installed at the position closer to the convex portion 12 and the hole 322 than the prism 170, the reflection portion 180, the hole 350, and the optical sensor 400. The convex portion 12 and the hole 322 are the rotational center of the movement of the ink cartridge 100 when the ink cartridge 100 is mounted on the carriage 300. That is, a turning radius of the terminal 360 and the terminal 361 is smaller than that of the prism 170 and the reflection portion 180. The terminal 360 of the carriage 300 side is resilient deformed downward from the state in which it protrudes from the upper surface of the wall portion 340, thereby maintaining the contact with the terminal 360 of the carriage 300 side. For this reason, when the ink cartridge 100 is mounted on the carriage 300, the terminal 360 of the carriage 300 side and the terminal 131 of the ink cartridge 100 side are connected to each others, before the prism 170 reaches the appropriate position with respect to the optical sensor 400.

Figure 6:
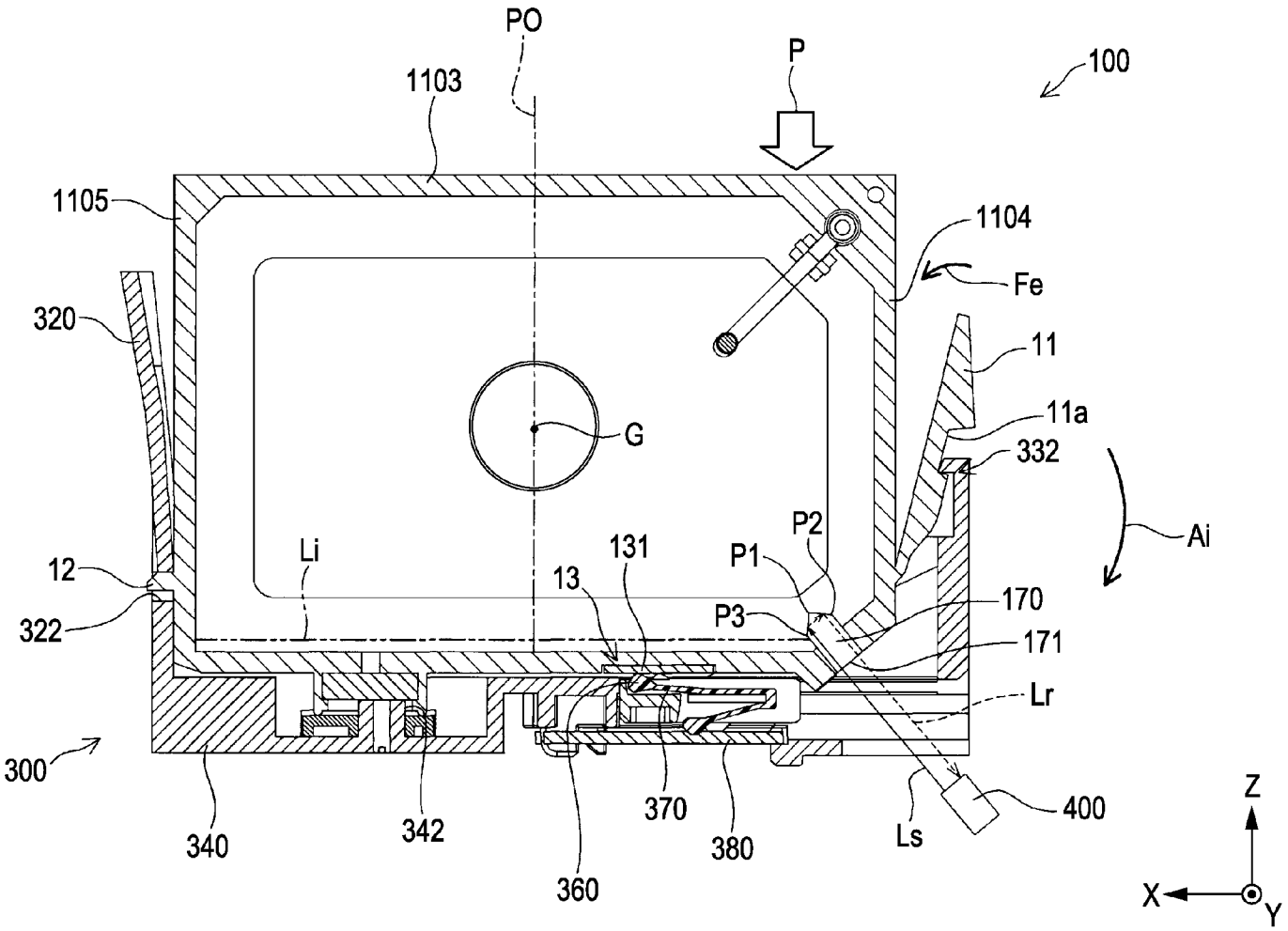
FIG. 6 is a cross-sectional view illustrating a state in which an ink cartridge is completely mounted on a carriage.

FIG. 6 is a cross-sectional view illustrating the state in which the ink cartridge 100 is completely mounted on the carriage 300. In the state shown in FIG. 6, the convex portion 12 of the ink cartridge 100 is fitted with the hole 322 of the carriage 300. In addition, the claw 332 of the carriage 300 is fitted with the concave portion 11*a* of the engagement lever 11 of the ink cartridge 100. The resilient portion 370 is resiliently deformed, and the terminal 360 is pushed down by the terminal 131, and thus is lowered to the substantially same position as the upper surface of the wall portion 340 in the negative Z-axis direction.

In the state shown in FIG. 6, the claw 332 of the carriage 300 is fitted with the concave portion 11*a* of the engagement lever 11 of the ink cartridge 100. For this reason, the ink cartridge 100 is not lifted by the resilient portion 370 and the terminal 360 to return to the state shown in FIG. 5.

In the state shown in FIG. 6, the CPU 270 of the printer 200 can acquire the information from the memory of the circuit board 13 of the ink cartridge 100 via the substrate 380, the terminal 360, and the terminal 131 of the circuit board 13 of the ink cartridge 100.

In addition, in the state shown in FIG. 6, the exposed portion 171 of the prism 170 is located at the position facing the optical sensor 400 of the printer 200. In this instance, it is regarded that the optical sensor 400 and the ink cartridge 100 are located at an appropriate relative position in the Y-axis direction. If the optical sensor 400 emits the light Ls toward the position, at which the exposed portion 171 of the prism 170 should be located, under the control of the CPU 270, the light is incident upon the prism 170.

When the ink cartridge 100 is mounted on the carriage 300, the ink cartridge 100 is an unused state, and the ink exists in the ink storage unit 101. That is, the front end portion (refer to the vertexes p1 to p3) of the prism 170 comes into contact with the ink. For this reason, the light incident onto the prism 170 is absorbed by the ink through the front end surface of the prism 170. As a result, the optical sensor 400 does not receive the reflected light Lr. In FIG. 6, a trajectory of the reflected light Lr is indicated by a dashed line.

After that, if the printing is carried out to spend the ink, the liquid level of the ink in the ink storage unit 101 is lowered. If the liquid level of the ink is lowered to, for example, Li, the front end portion (refer to the vertexes p1 to p3) of the prism 170 does not come into contact with the ink, but comes into contact with the air. At that time, if the optical sensor 400 emits the light Ls toward the position at which the exposed portion 171 of the prism 170 should be located, the light is reflected from the front end portion (refer to the vertexes p1 to p3) of the prism 170. The reason is that the refractive index of the material of the prism 170 is higher than that of the air. The optical sensor 400 receives the reflected light Lr.

After the ink runs out in the ink storage unit 101, in a case where the ink cartridge 100 is detached from the carriage 300, the engagement lever 11 is resilient deformed in the direction indicated by the arrow Fe to release the fitting of the concave portion 11*a* and the claw 332. While the state is maintained, the ink cartridge 100 can be detached by lifting the prism 170 of the wall portion 1103 of the ink cartridge 100, and the portion of the reflection portion 180 side in the direction (positive Z-axis direction) opposite to the arrow P.

The CPU 270 of the printer 200 performs the control as shown in Table 1 depending upon the signal received from the circuit board 13 of the ink cartridge 100 by the CPU 270, and the light quantity of the reflected light received by the optical sensor 400. More specifically, the CPU 270 performs the determination on the following three determined references to execute the control according to the determined result:

(a) when the ink cartridge 100 is mounted, or when the printing is performed;

(b) whether the CPU can receive the signal from the circuit board 13 of the ink cartridge 100; and (c) whether or not the light quantities of the reflected light received by the optical sensor 400 is the predetermined value or more.

In this instance, the predetermined value (refer to the above (c)) which is a threshold value of the light quantities of the reflected light can be set based on the quantity V1 of the light received by the optical sensor 400 in the state shown in FIG. 4, the amount V2 of the light received by the optical sensor 400 in the state shown in FIG. 5, the amount V3 of the light received by the optical sensor 400 in the case that the ink exists in the ink storage unit 101 under the state shown in FIG. 6, and the amount V4 of the light received by the optical sensor 400 in the case that the ink does not exist in the ink storage unit 101 under the state shown in FIG. 6. The predetermined value V0 which is a threshold value of the light quantities of the reflected light may be greater than V1 and V3, and may be smaller than V2 and V4.

TABLE 1

| | | Able to receive signal from cartridge | Not able to receive signal from cartridge |
|---|---|---|---|
| At mounting of cartridge | Reflected light quantity is predetermined value or more | b. displaying of incomplete mounting | — |
| | Reflected light quantity is less than predetermined value | c. displaying of complete mounting | a. displaying of non-mounting |
| At printing | Reflected light quantity is predetermined value or more | e. displaying of small residual amount of ink | — |
| | Reflected light quantity is less than predetermined value | d. displaying of printable state | — |

Now, two cases will be described: when a new ink cartridge 100 is mounted on the carriage 300 before printing; and when the printing is executed.

As to determining (the above (a)) whether the mounting of the ink cartridge 100 is in progress, and whether the printing is in progress, the CPU 270 can perform the following, for example. During a time after receiving an input stating that the printing is executed, and until the printing is completed, the CPU 270 determines that the printing is in progress. However, after receiving an input stating that the cartridge is exchanged, from a user, and during a time after receiving an input stating that the mounting of the cartridge is completed, from a user, and until the complete mounting of the cartridge is verified, the CPU determines that the mounting of the ink cartridge 100 is in progress. At that time, the input of various instructions from the user is performed through the group of buttons 250. In addition, a method of verifying the complete mounting of the cartridge will be described later.

The state when a new ink cartridge 100 is mounted on the carriage 300 corresponds to the state described on the second line from the top in Table 1. When a new ink cartridge 100 is mounted on the carriage 300, the state is transferred from the state shown in FIG. 4 to the state shown in FIG. 6 through the state shown in FIG. 5. In this instance, when a new ink cartridge 100 is mounted on the carriage 300, the ink of an amount sufficient to immerse the front end portion (refer to vertexes p1 to p3) of the prism 170 under the liquid level of the ink exists in the ink storage unit 101.

First, in the state shown in FIG. 4, the terminal 131 of the ink cartridge 100 side does not come into contact with the terminal 360 of the carriage 300 side. This causes the CPU 270 not to receive the signal from the circuit board 13 of the ink cartridge 100. That is, it corresponds to the state described in lines of a right column in Table 1.

In the state shown in FIG. 4, the optical sensor 400 does not receive the reflected light Lr. That is, the quantity of the light received by the optical sensor 400 is less than the predetermined value. Accordingly, the state shown in FIG. 4 corresponds to the state of the section a in Table 1. At that time, the CPU 270 allows the liquid crystal display 240 (refer to FIG. 1) to display "ink cartridge is not mounted". The user who has watched the display can prepare the ink cartridge 100 and then mount it.

Next, in the state shown in FIG. 5, the terminal 131 of the ink cartridge 100 side comes into contact with the terminal 360 of the carriage 300 side. This causes the CPU 270 to receive the signal from the circuit board 13 of the ink cartridge 100. That is, it corresponds to the state described in a second column from the right in Table 1.

In this instance, the signal used to determine whether the signal from the circuit board 13 of the ink cartridge 100 can be received or not may be a signal indicating the kinds of ink or a signal indicating the residual amount of the ink previously recorded in the memory of the circuit board 13. In addition, the signal may be other signals. That is, in the case where any signal is received from the circuit board 13 of the ink cartridge 100, the CPU 270 determines that a signal can be received from the circuit board 13 of the ink cartridge 100.

In the state shown in FIG. 5, the optical sensor 400 receives the reflected light Lr from the reflection portion 180. That is, the quantity of light received by the optical sensor 400 is the predetermined value or more. Accordingly, the state shown in FIG. 5 corresponds to the state of the section b in Table 1. At that time, the CPU 270 allows the liquid crystal display 240 (refer to FIG. 1) to display "mounting of ink cartridge is insufficient". The user who has watched the display pushes the ink cartridge 100 down, as indicated by the arrow P in FIG. 5, to completely mount the ink cartridge 100 on the carriage 300 (refer to FIG. 6). Accordingly, the user can prevent a situation encountering a problem, for example, in that the printing starts in the state in which the ink cartridge 100 is incompletely mounted, so that data stored in the circuit board 13 of the ink cartridge 100 is destroyed.

In the state shown in FIG. 6, the terminal 131 of the ink cartridge 100 side comes into contact with the terminal 360 of the carriage 300 side. This causes the CPU 270 to receive the signal from the circuit board 13 of the ink cartridge 100. That is, it corresponds to the second column from the right in Table 1.

In addition, in the state shown in FIG. 6, the optical sensor 400 does not receive the reflected light Lr. The reason is that the light emitted from the optical sensor 400 is absorbed by the ink in the ink storage unit 101 at the front end portion (the vertexes p1 to p3) of the prism 170. For this reason, the quantity of light received by the optical sensor 400 is less than the predetermined value. Accordingly, the state shown in FIG. 6 corresponds to the state of the section c in Table 1. At that time, the CPU 270 allows the liquid crystal display 240 to display "ink cartridge is mounted". The user who has watched the display can start the printing process.

Meanwhile, the state at printing corresponds to the state described in two lower lines in Table 1. In addition, at printing, the terminal 131 of the ink cartridge 100 side comes into contact with the terminal 360 of the carriage 300 side. This causes the CPU 270 to receive the signal from the circuit board 13 of the ink cartridge 100. The state corresponds to the state described in the second line from the right in Table 1. That is, the state at printing is any one state which is in the second column from the right in Table 1 and is of two lower lines in Table 1.

The state at printing start is the state shown in FIG. 6, and the ink of an amount sufficient to immerse the front end portion (refer to vertexes p1 to p3) of the prism 170 under the liquid level of the ink exists in the ink storage unit 101. For this reason, the light emitted from the optical sensor 400 is observed by the ink in the ink storage unit 101 at the front end portion (refer to vertexes p1 to p3) of the prism 170. Accordingly, the quantity of light received by the optical sensor 400 is the predetermined value or less. That is, the state corresponds to the state of the section d in Table 1. At that time, the CPU 270 allows the liquid crystal display 240 to display "printable state". The user who has seen the display can perform the printing.

After that, if the ink is spent and the liquid level of the ink is lowered to the level Li indicated by a chain double-dashed line, the front end portion (refer to the vertexes p1 to p3) of the prism 170 comes into contact with the air in the ink storage unit 101. For this reason, the light emitted from the optical sensor 400 is reflected from the front end portion (refer to vertexes p1 to p3) of the prism 170, and thus the optical sensor 400 receives the reflected light Lr. Accordingly, the quantity of light received by the optical sensor 400 is the predetermined value or more. The state corresponds to the state of the section e in Table 1. In this instance, the CPU 270 allows the liquid crystal display 240 to display "ink will soon run out". The user who has watched the display stops the new printing, and prepares a new ink cartridge. Therefore, it is possible to prevent a situation where the ink runs out during printing, and thus incomplete printing with a lack of some colors is produced.

In this embodiment, it is possible to verify whether the mounting of the ink cartridge is completely performed by using the optical sensor 400 and the prism 170 which are used to detect the residual amount of ink (the second column from the left in Table 1). In addition, it is possible to verify whether the mounting of the ink cartridge is completely performed based on whether to receive the signal to acquire the original information necessary for the printing or not (refer to the uppermost section in Table 1), such as a signal indicating the kinds of ink. For this reason, it is possible to verify whether the mounting of the ink cartridge is completely performed or not by using the configuration required for other purposes. Therefore, the printer and the ink cartridge can be achieved in reducing the size and cost thereof.

In addition, in this embodiment, the state in which the ink cartridge is incompletely mounted is uniquely set by the fitting of the convex portion 12 of the ink cartridge 100 with the hole 322 of the carriage 300, the weight of the ink cartridge 100, and the resilient portion 370. For this reason, it can detect the state, in which the ink cartridge is incompletely mounted, with high precision.

In this instance, the printer 200 corresponds to the "liquid ejecting apparatus" in the Summary. Similarly, the ink cartridge 100 corresponds to the "liquid container"; the ink storage unit 101 corresponds to the "storage unit"; the prism 170 corresponds to the "optical member"; the reflection portion 180 corresponds to the "reflection portion"; the direction indicated by the arrow Ai corresponds to the "mounting direction"; the convex portion 12 corresponds to the "fitting portion" of the liquid container; and the terminal 131 corresponds to the "terminal" of the liquid container.

In this embodiment, the printer 200 mounted with the ink cartridge 100 corresponds to the "liquid ejecting system" in the Summary. Similarly, the optical sensor 400 corresponds to the "optical sensor"; the liquid crystal display 240 corresponds to the "display unit"; and the CPU 270 corresponds to the "control unit".

In this embodiment, the display (refer to the section e in Table 1) stating "ink will run out soon" corresponds to the "first display" in the Summary. Similarly, the display (refer to the section d in Table 1) stating "printable state" corresponds to the "second display"; the display (refer to the section b in Table 1) stating "mounting of ink cartridge is insufficient" corresponds to the "third display"; and the display (refer to the section c in Table 1) stating "ink cartridge is mounted" corresponds to the "fourth display".

In this embodiment, the convex portion 12 corresponds to the "first fitting portion" in the Summary. Similarly, the hole 322 corresponds to the "second fitting portion"; the terminal 360 corresponds to the "first terminal"; the terminal 131 corresponds to the "second terminal" the concave portion 11*a* corresponds to the "third fitting portion"; the claw 332 corresponds to the "fourth fitting portion"; and the resilient portion 370 corresponds to the "resilient member".

B. Modified Examples

In this instance, the invention is not limited to the preferred embodiments, and various aspects can be made within the scope without deviating from the gist. For example, the following modifications can be made.

B1. Modified Example 1

In the above-described embodiment, the ink cartridge 100 is provided with the convex portion 12 as the first fitting portion, and the carriage 300 is provided with the hole 322 as the second fitting portion. However, in the first and second fitting portions, one may be a concave portion, while the other may be a convex portion. That is, the first and second fitting portions may be configured to be fitted with each other. However, it is desirable that the one portion receives the other portion. In addition, it is desirable that the first and second fitting portions are configured to rotate in a predetermined direction (insertion direction of the liquid container) within a predetermined angle range in the mutually fitting state.

In the above-described embodiment, the ink cartridge 100 is provided with the convex portion 11*a* as the third fitting portion, and the carriage 300 is provided with the claw 332 as the second fitting portion. However, in the third and fourth fitting portions, one portion may be a concave portion, while the other portion may be a convex portion. That is, the third and fourth fitting portions may be configured to be fitted with each other. However, it is desirable that the third and fourth fitting portions are configured in such a manner that at least one portion is resiliently deformed. In this instance, the term "resilient deformation" herein includes a displacement with the resilient force.

B2. Modified Example 2

In the above-described embodiment, the convex portion 12 is installed near the lower end of the wall portion 1105 of the ink cartridge 100 as the first fitting portion. The hole 322 is installed near the lower end of the wall portion 320 of the carriage 300 as the second fitting portion. However, the first fitting portion may be installed at other positions, such as near the upper end of the wall portion of the liquid container or the like. The second fitting portion may be installed at other positions, such as near the upper end of the wall portion of the carriage or the like.

However, it is desirable that the first fitting portion is installed at the position corresponding to the second fitting portion. In addition, it is desirable that the first fitting portion is installed at a corner portion of the liquid container. If such an aspect is made, when the liquid container is mounted on the liquid ejecting apparatus, it is easy to initially fit the first fitting portion with the second fitting portion.

B3. Modified Example 3

In the above-described embodiment, the reflection portion 180 can reflect the received light. The prism 170 does not reflect the received light when the ink exists in the ink storage unit 101. The prism 170 reflects the received light when the ink does not exist in the ink storage unit 101. Meanwhile, it is desirable that the portion which constitutes the other outer surface of the ink cartridge 100 and encloses the exposed surface 171 of at least the reflection portion 180 and the prism 170 is made of a material capable of reflecting light of an amount smaller than the reflected light of the reflection portion 180 and the prism 170, or a material which almost does not reflect the light.

B4. Modified Example 4

In the above-described embodiment, the prism 170 and the reflection portion 180 are positioned in the hole 350 (refer to FIG. 6), in the state in which the ink cartridge 100 is appropriately mounted on the carriage 300. However, in the state in which the ink cartridge 100 is appropriately mounted on the carriage 300, another aspect may be made in which the prism 170 is positioned in the hole 350, while the reflection portion 180 is not positioned in the hole 350. In such an aspect, in the state in which the ink cartridge 100 is incompletely mounted on the carriage 300 (refer to FIG. 5), it is desirable that the reflection portion 180 is positioned in the hole 350.

B5. Modified Example 5

In the above-described embodiment, in the state in which the convex portion 12 serving as the first fitting portion is inserted into the hole 322 serving as the second fitting portion, the ink cartridge 100 is rotated, and then is mounted on the printer 200 (carriage 300). However, the ink cartridge may be mounted in other methods, for example, it is inserted in a straight shape while maintaining a constant posture to the printer. In such an aspect, it is possible to detect the incomplete mounting of the liquid container by the optical member and the reflection portion which is installed at the position in front of the optical member in the mounting direction of the liquid container to the liquid ejecting apparatus.

B6. Modified Example 6

In the above-described embodiment, the ink cartridge 100 is resiliently supported on the carriage 300 by the resilient portion 370 (refer to FIG. 5). In that state, the reflection portion 180 is located at the position facing the optical sensor 400 of the printer 200. However, the resilient member, which supports the ink cartridge 100 in the state in which the reflection portion 180 is located at the position facing the optical sensor 400, may be installed at the ink cartridge 100 side. In such an aspect, it is desirable that the member connected to the resilient member, or the resilient member itself protrudes from the lower end surface of the ink cartridge 100. In the state in which the ink cartridge 100 is pushed into the printer 200 (carriage 300) against the resilient force of the resilient member, the resilient member is resiliently deformed, so that the claw 332 and the concave portion 11*a* of the engagement lever 11 can be fitted with each other.

In addition, the resilient member, which supports the ink cartridge 100 in the state in which the reflection portion 180 is located at the position facing the optical sensor 400, may be installed at both sides of the ink cartridge 100 and the printer 200.

B7. Modified Embodiment 7

In the above-described embodiment, during the time after receiving a command stating that the printing is executed, and until the printing is completed, the CPU 270 determines that the printing is in progress. After receiving an input stating that the cartridge is exchanged, from a user, and during a time after receiving an input stating that the mounting of the cartridge is completed, from a user, and until the complete mounting of the cartridge is verified, the CPU determines that the mounting of the ink cartridge 100 is in progress. However, the determination whether the mounting of the ink cartridge is in progress or the printing is in progress may be performed by other methods.

For example, other than during the time after receiving the input stating that the mounting of the cartridge is completed, from the user and until the complete mounting of the cartridge is verified, a control of verifying the residual amount of the ink may be performed at a constant time interval. In addition, regardless of whether to receive the input stating that the cartridge is exchanged or not, during the time after receiving the input stating that the mounting of the cartridge is completed from the user and until the complete mounting of the cartridge is verified, it may be determined that the mounting of the ink cartridge 100 is in progress.

That is, the determination whether the mounting of the ink cartridge is in progress or the printing is in progress may be performed by other various methods based on the input from the user.

B8. Modified Example 8

In the above-described embodiment, in the state described in the section a in Table 1, the CPU 270 allows the liquid crystal display 240 (refer to FIG. 1) to display "ink cartridge is not mounted". However, in the state described in the section a, the CPU 270 may perform another display, or may not perform any display.

In addition, in the above-described embodiment, in the state described in the section d in Table 1, the CPU 270 allows the liquid crystal display 240 to display "printable state". However, in the state described in the section d, the CPU 270 may perform another display, or may not perform any display.

B9. Modified Example 9

The above-described embodiment is exemplified the printer capable of independently performing the printing based on the image data file stored in the memory medium, without being connected to the external computer. However, the invention may be applied to a printer which is connected to a computer, and performs the printing according to the control of the computer. In such an aspect, the display connected to the computer may serve as the "display unit" which performs various displays for a user.

B10. Modified Example 10

In the above-described embodiment, the ink cartridge 100 is an ink cartridge for the printer 200 which is used for the home or office. However, the ink cartridge serving as the liquid container of the invention may be applied to an ink cartridge of a large printer used for business.

In addition, in the above-described embodiment, an ink jet printer (so-called printer of an on cartridge type) is exemplified in which a carriage mounted with a cartridge is formed integrally with a printing head and reciprocates in a sheet widthwise direction of a printing medium. However, the liquid container of the invention may be applied to an ink jet printer (so-called printer of an off cartridge type), in which the ink cartridge 100 is installed as a main tank, separate from the carriage provided with the printing head and the sub tank. In such an aspect, it is desirable that the optical sensor is provided corresponding to each ink cartridge 100.

B11. Modified Example 11

In the above-described embodiment and the modified examples, although the ink jet printer and the ink cartridge are explained, the invention may be applied to a liquid ejecting apparatus for ejecting or discharging a liquid other than ink. In addition, the invention may be applied to a liquid container which stores such a liquid. The liquid container of the invention may be applied to various liquid consuming apparatuses including a liquid ejecting head for ejecting a minute number of liquid droplets. In this case, the expression "liquid droplets" means the liquid ejected from the liquid ejecting apparatus, and includes a liquid having a granular shape, a tear shape, or a thread shape as a trailing shape. Further, here, "the liquid" may be a material which can be ejected from the liquid ejecting apparatus. For example, a liquid-state material may be used, and includes a liquid-state material such as sol or gel water having high or low viscosity, a fluid-state material such as an inorganic solvent, an organic solvent, a fluid, a liquid-state resin, or liquid-state metal (metallic melt), and a material in which particles of a functional material having a solid material such as a pigment or a metal particle are dissolved, dispersed, or mixed with a solvent in addition to a fluid, as one state of a substance. In addition, ink described in the embodiments may be exemplified as a typical example of the liquid. Here, the ink indicates general water-based ink, oil-based ink, gel ink, or hot-melt ink which contains various liquid compositions. As a detailed example of the liquid ejecting apparatus, for example a liquid ejecting apparatus for ejecting a liquid containing dispersed or melted materials such as an electrode material or a color material used to manufacture a liquid crystal display, an EL (electro-luminance) display, a plane-emission display, or a color filter, a liquid ejecting apparatus for ejecting a biological organic material used to manufacture a biochip, or a liquid ejecting apparatus for ejecting a liquid as a sample used as a precision pipette. In addition, a liquid ejecting apparatus for ejecting lubricant by a pinpoint to a precision machine such as a watch or a camera, a liquid ejecting apparatus for ejecting a transparent resin liquid such as a UV-curing resin onto a substrate in order to form a minute hemispherical lens (optical lens) used for an optical transmission element or the like, or a liquid ejecting apparatus for ejecting an etching liquid such as an acid or an alkali in order to perform etching on a substrate or the like may be adopted. Furthermore, the invention can be applied to any one kind of these ejecting apparatuses and liquid containers.

What is claimed is:

1. A liquid ejecting system comprising:

a liquid ejecting apparatus which is configured to eject a liquid; and a liquid container which is configured to be mounted on the liquid ejecting apparatus to supply the liquid to the liquid ejecting apparatus, the liquid container comprising:

a storage unit configured to store the liquid;

a reflective portion provided on an outside of the liquid container and configured to reflect a light from the outside of the liquid container back to the outside of the liquid container; and an optical member comprising a first portion which is exposed to an inside of the storage unit, and a second portion which is exposed to the outside of the liquid container, wherein the optical member is configured to reflect the light from the outside of the liquid container back to the outside of the liquid container;

the liquid ejecting apparatus comprising:

an optical sensor which is configured to emit the light toward the liquid container when the liquid container is mounted on the liquid ejecting apparatus, and further configured to receive the reflected light reflected by the reflective portion and to receive the reflected light reflected by the optical member; and a control unit which performs:

a first determination that determines that mounting of the liquid container is insufficient in a first case where the optical sensor receives the reflected light over a threshold amount from the reflective portion;

a second determination that determines that mounting of the liquid container is sufficient in a second case where the optical sensor does not receive the reflected light over the threshold amount from any of the reflective portion or the optical member, wherein the second determination comprises light entering the optical member and subsequently entering the inside of the storage unit by being absorbed by the liquid in the liquid container; and a third determination that, after the second determination has determined that mounting of the liquid container is sufficient, determines that the liquid in the liquid container is spent in a third case where the optical sensor receives the reflected light over the threshold amount from the optical member.

2. The liquid ejecting system according to claim 1, wherein the liquid container further comprises:

a first fitting portion provided at a side opposite to the optical member and the reflective portion, in which, when the liquid container is mounted on the liquid ejecting apparatus, the first fitting portion is mounted further to a front side than the portion of the liquid container at which the optical member and the reflective portion are installed, and wherein the liquid ejecting apparatus further comprises a second fitting portion, wherein the first fitting portion is configured to be fitted with the second fitting portion.

3. The liquid ejecting system according to claim 2, wherein the liquid container further comprises:

a resilient member; and a third fitting portion which is provided at the same side as the optical member and the reflective portion;

wherein the liquid ejecting apparatus further comprises a fourth fitting portion;

wherein the third fitting portion is fitted with the fourth fitting portion when the liquid container is mounted on the liquid ejecting apparatus;

wherein the resilient member is configured to resiliently support the liquid container when the first fitting portion is fitted with the second fitting portion, the third fitting portion is not fitted with the fourth fitting portion, and the reflective portion reflects the light emitted from the optical sensor to the optical sensor; and wherein, when the liquid container is pushed into the liquid ejecting apparatus against a resilient force of the resilient member, the third fitting portion is fitted with the fourth fitting member, so that the liquid container is mounted on the liquid ejecting apparatus.

4. The liquid ejecting system according to claim 2, wherein the liquid container further comprises a third fitting portion which is provided at the same side as the optical member and the reflective portion;

wherein the liquid ejecting apparatus further comprises:

a fourth fitting portion, wherein the third fitting portion is fitted with the fourth fitting portion when the liquid container is mounted on the liquid ejecting apparatus; and a resilient member, wherein the resilient member is configured to resiliently support the liquid container when the first fitting portion is fitted with the second fitting portion, the third fitting portion is not fitted with the fourth fitting portion, and the reflective portion reflects the light emitted from the optical sensor to the optical sensor; and wherein, when the liquid container is pushed into the liquid ejecting apparatus against a resilient force of the resilient member, the third fitting portion is fitted with the fourth fitting member, so that the liquid container is mounted on the liquid ejecting apparatus.

5. The liquid ejecting system according to claim 1, wherein the liquid ejecting apparatus further comprises a first terminal coupled to the control unit; and wherein the liquid container further comprises a second terminal which comes into contact with the first terminal of the liquid ejecting apparatus when the liquid container is mounted on the liquid ejecting apparatus, to send a signal to the control unit;

wherein the control unit performs the first determination after the control unit receives the signal.

6. The liquid ejecting system according to claim 1, wherein the liquid ejecting apparatus further comprises a display unit which performs a first display when the control unit performs the first determination, and performs a second display when the control unit performs the second determination, wherein the first display is different from the second display.

* * * * *